United States Patent [19]

Mola et al.

[11] 4,426,747

[45] Jan. 24, 1984

[54] WHEEL RIM BUFFER

[76] Inventors: Clark M. Mola, 500 E. 21st St., Yankton, S. Dak. 57078; Maurice L. Evans, 1401 Peninah, Yankton, S. Dak. 57078; Richard D. Beringer, 417 N. Pearl, Tyndall, S. Dak. 57066

[21] Appl. No.: 338,548

[22] Filed: Jan. 11, 1982

[51] Int. Cl.[3] ..... A46B 13/02

[52] U.S. Cl. ..... 15/21 D; 51/48 R

[58] Field of Search ..... 15/21 D, 21 E, 53 B; 51/48 R

[56] References Cited

U.S. PATENT DOCUMENTS 2,180,529 11/1939 Kaseberg ..... 51/48 R 2,707,851 5/1955 Strong ..... 15/21 D X 4,217,733 8/1980 Van Sickle ..... 15/21 D X

FOREIGN PATENT DOCUMENTS 198938 6/1967 U.S.S.R. ..... 15/21 D

*Primary Examiner*—Edward L. Roberts

[57] ABSTRACT

A polishing machine for wheel rims including a power driven wire brush or buffer mounted so as to be slidably movable axially of the shaft driving the brush. The wheel and rim are separately driven and are mounted so that it can be swiveled so as to tilt the wheel rim relative to the radial direction of the brush so that the brush can engage all the areas of a rim including the edges as well as the bottom of the rim.

8 Claims, 5 Drawing Figures

WHEEL RIM BUFFER

BACKGROUND AND SUMMARY OF THE INVENTION

This invention pertains to wheel rim buffers and more particularly to power driven buffers adapted to buff and clean the rims of wheels adapted for the mounting of pneumatic tires.

Automobile wheels adapted to receive pneumatic tires have developed from the days when a tire using an inner tube was mounted on a "demountable" rim which could be removed from the wheel and the rim collapsed so that the tire could be removed to the time when a "drop center" wheel in which the bead of the tire dropped into the center of the rim so that a part of the bead could be stretched over the rim and thus be removed, and now to the airtight drop center rim on which can be mounted a tubeless tire. The needs of each different type of rim may be different.

Specifically, the tubeless tire mounting must be airtight. This requirement extends not only to the construction of the rim but also to the seal between the bead of the tire and the rim. Therefore, irregularities particularly on the edge of the rim may well allow leakage of air between the rim and the bead of the tire. The irregularities may include such foreign matter as rust or mud or the like.

A wire brush may be used to clean rims—particularly used rims held for salvage—of such foreign matter. Such a brush may be power driven. However, hand holding such a driven brush is both tedious and inexact. A mounted, driven brush must be able to buff not only the cylindrical areas such as the bottom of the dropped center and the area on which the bead is seated, but also the edges of those areas, particularly the edge of the rim against which the outer surface of the bead seats.

In order to accomplish that requirement, we provide a device in which the wheel and brush are separately driven although they are mounted on the same stand. We then provide that one of the two—preferably the wheel and its drive means be swiveled relative to the brush and its drive. In this way, the brush enters the rim at an angle to the radial and can buff the edges as well as the cylindrical surfaces.

FIGURES

DESCRIPTION

Figure 1:
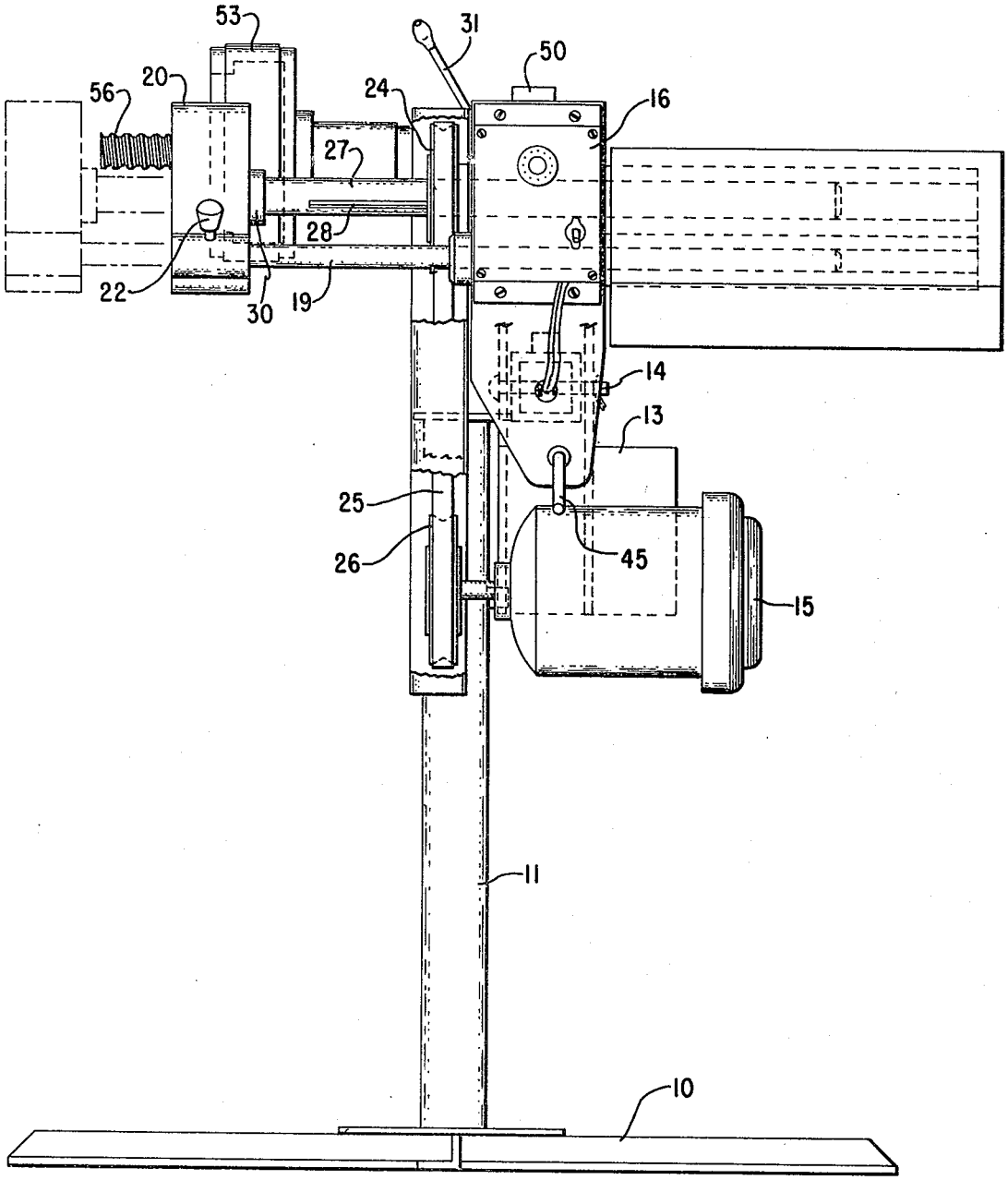
FIG. 1 is a front elevational view of our device.
Figure 2:
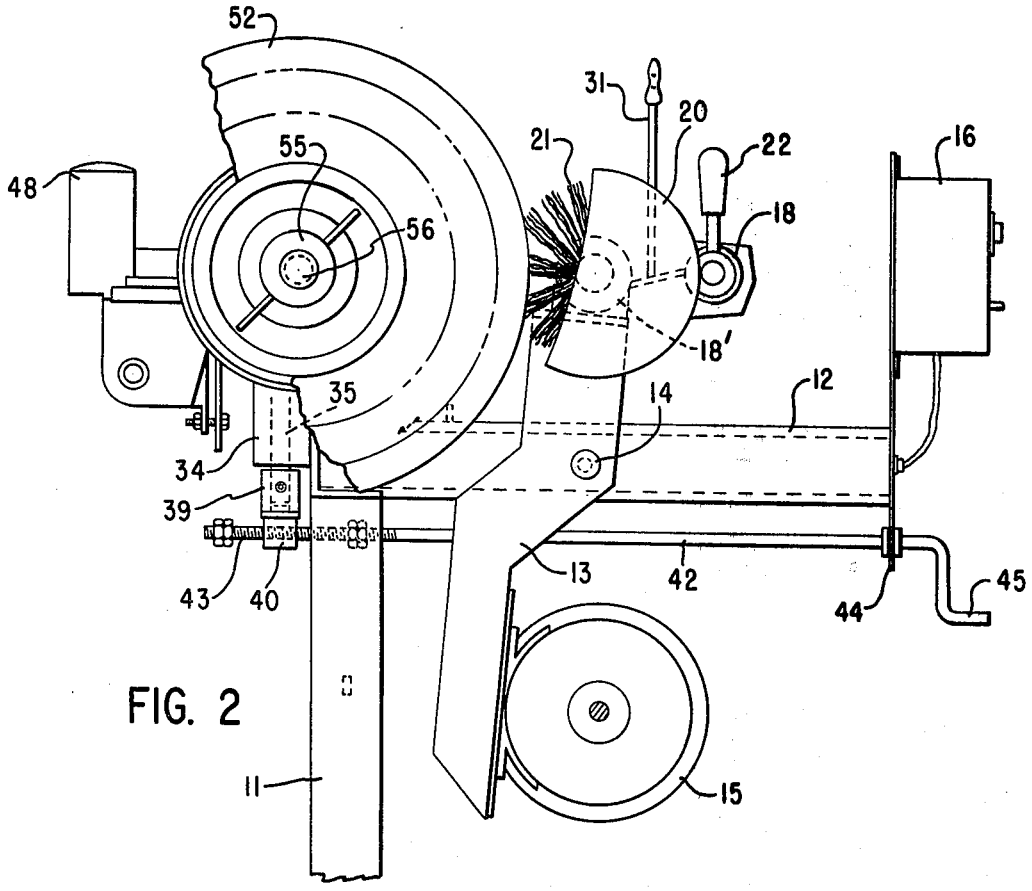
FIG. 2 is a side elevational view of the operation position of the device to an enlarged scale.

Briefly our device comprises a stand on which is mounted a motor driven wire brush adapted to be moved laterally. A separately driven wheel mounting device adapted to turn the wheel slowly is also mounted on the stand so that it can be swiveled somewhat so that the radial direction of the brush will not necessarily parallel that of the wheel.

More specifically and referring to the drawings, the device is mounted on a stand having a base 10 adapted to stand on a flat surface, and an upright member 11. At the upper end of the upright 11, a bar 12 is fixed to the upright to form a support for the operating parts of the device. For purposes of this description, the direction of this bar shall be considered longitudinal of the device. As shown in the figures, the bar 12 may be somewhat offset from the upright 11 to provide for a more nearly balanced load on the support.

The buffer mechanism is pivotally mounted on the bar 12. Specifically, a tilting mount 13 is mounted on the bar 12 by means of a pivot pin 14 about which the mount 13 will pivot. Below the pin 14 the mount provides for mounting a motor 15. The electrical power and controls for this motor are through a switch box 16 mounted on the bar 12.

On the mount 13 above the pivot 14, there are a pair of bearing mounts 18 and 18'. The bearing in mount 18 provides for lateral sliding movement of a rod 19 on which is mounted a guard 20 partially covering the buffing brush 21, which may be any simple wire brush used for such tasks as buffing rust from iron material. A handle 22 is provided on the guard 20 or adjacent to it so that the guard and its related means can be slidably moved.

The bearing mount 18' holds a bearing on which is mounted a pulley 24 (FIG. 1) which is driven through a belt 25 from the pulley 26 on the motor 15. A shaft 27 is slidably mounted axially of the pulley 26. A keyway 28 (FIG. 1) on the shaft is adapted to be drivingly engaged by a key (not shown) in the pulley in a manner well known in the art. The shaft 27 carries the brush 21. Thus, the motor 15 drives the pulley 24 which in turn rotates the brush 21 through the shaft 27. A collar 30 may be provided to engage the guard 20 so that lateral motion of the guard sliding the rod 19 will carry with it the brush 21 on its shaft 27.

Rocking or tilting motion of the entire buffer mechanism just described can be controlled by a handle 31 fixed to the mount 13. This motion is useful in moving the brush toward or away from the rim to be cleaned as will later appear.

Figure 5:
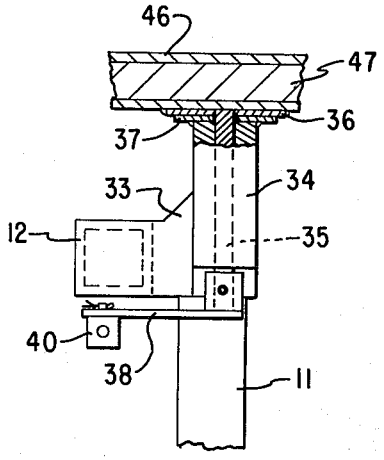
FIG. 5 is a detailed end view of the mechanism for swiveling the wheel holding mechanism apart of from other mechanism.
Figure 3:
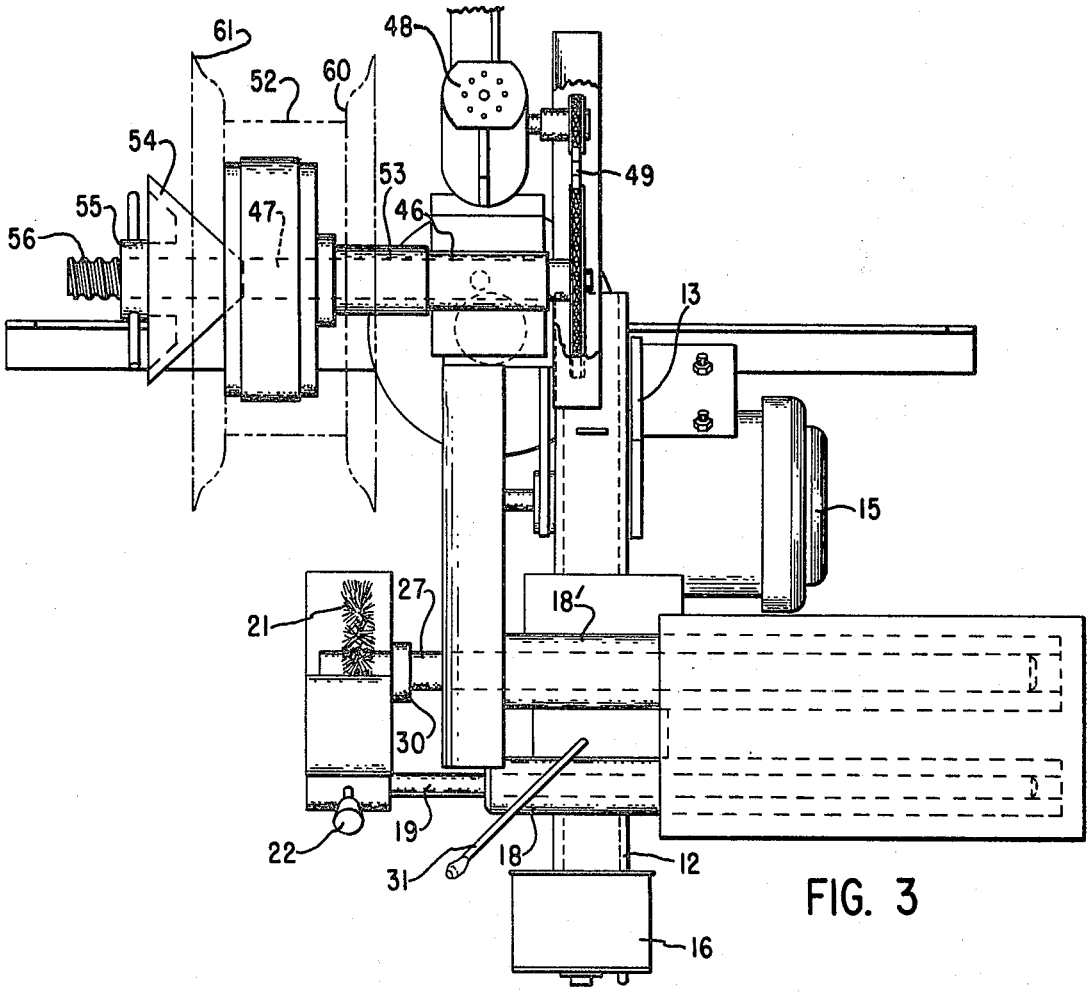
FIG. 3 is a top plan view of the drive.
Figure 4:
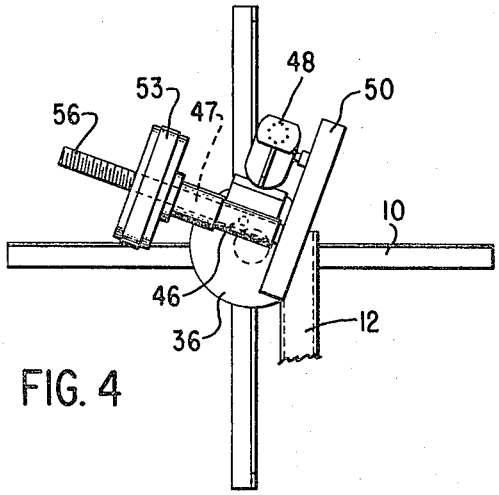
FIG. 4 is a top plan view to a reduced scale of the wheel holding part of the device apart from the buffing mechanism.

The mounting means for the wheel whose rim is to be cleaned is also mounted on the bar 12. This mounting means includes a bearing support bracket 33 (FIG. 5) on which is mounted a bearing means 34. A shaft 35 is journalled in the bearing on a substantially vertical axis and carries at its upper end a disk 36 designed to rotate on a support disk 37 on the bearing means 34.

The mechanism to rotate the shaft 35 includes an arm 38 having a collar 39 fixed to the shaft 35. At the end of the arm opposite the collar 39 is a threaded thimble 40 pivotally mounted on the arm 38. A shaft 42 having a long threaded end 43 is threadably engaged with the thimble 40 and is journalled on a flange 44 mounted on the bar 12. A crank 45 formed on the rod 42 outside the flange 44 allows the rod 42 to be turned to rotate the thread 43 within the thimble 40. The threading action, in turn causes the arm 38 to turn the shaft 35 in its bearing and to move the assembly mounted on the disc 36.

The wheel carrying mechanism is mounted on the disc 36 and includes a journal 46 in which is journalled a shaft 47. This shaft is driven, preferably at a relatively low rate of speed by a geared motor 48 through a sprocket and chain arrangement 49. Preferably the sprockets and chain are enclosed in a housing 50.

The end of the shaft 47 opposite the driving means is adapted to hold the wheel of an automobile or a similar wheel 52. This wheel is held onto the shaft by means well known in the art. Those means may include proper spacers 53, cones 54 and wing nuts 55 threaded onto a threaded end 56 of the shaft 47. In this way, the wheel 52 can be slowly rotated by the shaft 47 and in front of the wire brush 21 or similar buffer.

In operation, the device is first loaded by clamping a wheel 52 on the shaft 47 by means of the cone 54 and nut 55. Normally, at the beginning of the operation, the axes of rotation of the wheel 52 and of the brush or buffer 21 would be parallel. In this position, both motors 15 and 48 would be powered and the wheel would slowly revolve on its axis as the brush 21 rotated much more rapidly.

The brush 21 would then be slidably moved to proper position to engage the rim of the wheel 52 and would be tilted by using the handle 31 so that the brush engaged and cleaned those parts of the rim which were essentially cylindrical or had a component surface lying—at least in part—parallel to the axis of the wheel. Parts of the rim lying perpendicular to the axis such as the walls 60 of the drop center, or shoulders 61 on the rim could not be effectively cleaned. However, when the first brushing is satisfactorily completed, the crank 45 can be turned to rotate the vertical shaft 35 on which the wheel holding assembly is mounted. This turns the axis of the wheel 52 at an angle so that of the brush 21 and provides for proper buffing or brushing contact with the previously unreached parts. During all of the operation, the brush can be slid sideways by sliding the rod 19 and shaft 27 using the handle 22 and can be tilted against the rim or moved away by tilting the entire buffing assembly using the handle 31. Thus the entire surface of the inner part of the rim can be properly brushed clean of rust and the like and can be buffed.

I claim:

1. A device for cleaning the rim of a wheel comprising a stand including longitudinal support means, motor driven buffer means mounted on said support means for slidable lateral motion relative to said support means and for longitudinal motion along said support means, wheel support means including shaft means for holding the wheel and drive means drivingly engaged with said shaft means and adapted to rotate said wheel adjacent said buffer means, said wheel support means being pivotally mounted on said stand whereby said wheel support means, including said shaft means, may be pivoted on an axis substantially perpendicular to the axis of said shaft means.

2. The device of claim 1 in which said buffer means is tiltably mounted on said stand to provide for said longitudinal motion.

3. The device of claim 2 in which said buffer means includes mounting means extending both above and below said longitudinal support means, pivot means engaged between said mounting means and said support means by which said mounting means is pivotally movable relative to said stand, motive means on said mounting means below said pivot means, and driven rotary buffing means slidably mounted for lateral movement on said mounting means above said pivot means, said buffing means being in driven engagement with said motive means.

4. The device of claim 3 in which the slidable mounting for said rotary buffing means includes bearing mounts on said mounting means, slidable means slidably journalled in said bearing mounts, at least one of said slidable means being a shaft driven from said motive means, brush means mounted on said shaft whereby said brush means is driven by said motive means, and a handle attached to said mounting means whereby the buffer means can be tilted and thus such brush means can be moved in a longitudinal direction.

5. The device of claim 4 in which said wheel support means includes a support shaft journalled on a part of said longitudinal support means, journal means on said support shaft, said shaft means including a wheel shaft rotatably journalled in said journal means, mounting means on said wheel shaft whereby a wheel may be mounted thereon, driving means engaged with said wheel shaft whereby said wheel can be turned adjacent said brush means, arm means on said support shaft, threaded nut means carried by said arm means, crank means having a threaded end threadably engaged with said nut means, said crank means being supported from said longitudinal support means whereby rotation of said crank means will cause movement of an end of said arm means to swivel said support shaft.

6. The device of claim 5 in which said motive means and said driving means both include electrically operated power means and control means mounted on said longitudinal support means electrically connected to both said power means to actuate said power means.

7. The device of claim 1 in which said wheel support means includes a support shaft journalled in a part of said support means, wheel carrying means on said support shaft adapted to hold said wheel rotatably adjacent said buffing means and means engaged with said support shaft adapted to pivot said shaft whereby the axis of said wheel is swiveled relative to said buffing means.

8. The device of claim 1 in which said wheel support means includes a support shaft pivotally mounted on said stand, arm means on said support shaft, threaded nut means carried by said arm means and crank means having a threaded end threadably engaged with said nut means, said crank means being supported by said longitudinal support means whereby rotation of said crank means will cause movement of an end of said arm means to swivel said support shaft.

* * * * *